US006851969B2

(12) United States Patent
Archuletta

(10) Patent No.: US 6,851,969 B2
(45) Date of Patent: Feb. 8, 2005

(54) PIGTAILED SCOTCHCAST ASSEMBLY

(76) Inventor: David Archuletta, 178 Miller St., Ludlow, MA (US) 01056

( * ) Notice: Subject to any disclaimer, the term of this patent is extended or adjusted under 35 U.S.C. 154(b) by 0 days.

(21) Appl. No.: 10/446,443

(22) Filed: May 28, 2003

(65) Prior Publication Data

US 2004/0242056 A1 Dec. 2, 2004

(51) Int. Cl.[7] ..... H01R 11/00
(52) U.S. Cl. ..... 439/502
(58) Field of Search ..... 439/502, 518, 439/589, 638, 527, 592, 559

(56) References Cited

U.S. PATENT DOCUMENTS

| | | | | |
|---|---|---|---|---|
| 2,247,336 A | | 6/1941 | John | 173/328 |
| 2,312,002 A | | 2/1943 | Schmitt | 173/328 |
| 2,912,667 A | | 11/1959 | Sloat | |
| 2,962,688 A | | 11/1960 | Werner | |
| 3,229,240 A | | 1/1966 | Harrison et al. | |
| 3,753,766 A | | 8/1973 | Brown et al. | 117/97 |
| 3,821,558 A | | 6/1974 | Weber | 200/129 |
| 3,885,849 A | * | 5/1975 | Bailey et al. | 439/518 |
| 4,309,128 A | | 1/1982 | Williams | 405/154 |
| 4,810,209 A | | 3/1989 | Punako et al. | 439/589 |
| 4,911,579 A | * | 3/1990 | Lutz et al. | 405/184 |
| 5,372,162 A | | 12/1994 | Frey | 138/98 |
| 5,709,503 A | | 1/1998 | Manlow | 405/154 |
| 6,007,372 A | * | 12/1999 | Wood | 439/502 |
| 6,250,955 B1 | * | 6/2001 | Archuleta | 439/502 |

* cited by examiner

*Primary Examiner*—J. F. Duverne
(74) *Attorney, Agent, or Firm*—McCormick, Paulding & Huber LLP

(57) ABSTRACT

An integrated inspection apparatus for selectively accepting an electrical cable includes a scotchcast having a housing through which the electrical cable extends. The inspection apparatus further includes a block clamp having a passage formed along its longitudinal axis for accommodating a portion of the electrical cable, the portion the portion of the electrical cable being disposed outside of the scotchcast. The block clamp further includes a cap portion which is selectively actuated to provide a compressive force on the electrical cable without deforming an exterior profile of the block clamp.

20 Claims, 4 Drawing Sheets

PIGTAILED SCOTCHCAST ASSEMBLY

FIELD OF THE INVENTION

The present invention relates generally to a pigtailed scotchcast assembly, and deals more particularly with an apparatus that provides for the efficient exchange or replacement of pigtails from a pigtailed scotchcast assembly while also increasing the pulling capacity of the scotchcast assembly.

BACKGROUND OF THE INVENTION

A pigtailed scotchcast assembly is utilized in those fields requiring either pre- or post-inspection of extended cavities, ducts or piping, such as but not limited to the sewer pipe relining industry. In such fields, it is typically necessary to inspect the condition of an extended cavity through the use of a plurality of electrical components. Cameras, lights, cutters and other components are utilized for this purpose and must each be supplied with electrical power to operate. As these cavities are either too confining, unsafe or otherwise unaccommodating for a human presence, the movement of electrical components along the length of any given cavity must be performed by mechanical means. A pigtailed scotchcast assembly is therefore enlisted to provide electrical power to the various components utilized, while also assisting in pulling such components and their associated electrical wiring through the cavity itself.

As is currently known and depicted in prior art FIG. 1, a typical pigtailed scotchcast assembly 10 is comprised of a scotchcast 12 having an electrical cable 14 entering one end thereof and a plurality of pigtails 16 exiting the opposing end of the scotchcast 12. The scotchcast 12 includes a pair of wings 18 each having an anchor hole 20 formed therein for dragging or pulling the pigtailed scotchcast assembly 10 along a cavity or piping. The electrical cable 14 is separated into differing bundles of conductors inside the body of the scotchcast 12 and subsequently emerges from the scotchcast 12 as pigtails 16. The interior of the scotchcast 12 is filled with a resin and catalyst compound which, when sufficiently dried and cured over time, provides a watertight sealant to the scotchcast 12 and the wire bundles therein.

As will be readily appreciated, when the pigtailed scotchcast assembly 10 is dragged or pulled through many cavities or pipes, the pigtails 16, including the protective sheathing covering the pigtails 16, tend to wear and become tattered, leading to operational failure of the supported electrical components. In these instances, inspection of the cavity or piping must be halted while the entire scotchcast assembly 10 is severed from the electrical cable 14 and another assembly attached in its place. This method is time-consuming, costly, requires expertise in electronics and must frequently accommodate the recommended 12-hour time period that a typical insulating and waterproofing resin and catalyst compound requires to cure.

Another known pigtailed scotchcast assembly 30 is shown in FIG. 2 and was the subject of commonly assigned U.S. Pat. No. 6,250,955, herein incorporated by reference in its entirety. As shown in FIG. 2, the two-piece pigtailed scotchcast assembly 30 is comprised of a first portion 32 capable of integrally and selectively mating with a second portion 34. The first portion 32 includes a central housing 35 from which a plurality of pigtails 36 are adapted to extend. The pigtails 36 each contain a varying number of electrical conductors and terminate in a connection end 38 for connection with various electrical components.

Still in reference to FIG. 2, the second portion 34 includes a threaded connection piece 46 having a female attachment end 48 and a connecting tip 50. The female attachment end 48 has exterior threads formed on the outer circumference thereof and further includes a plurality of pin receptacles 52. The pin receptacles 52 are arranged in number and orientation so as to match and integrally mate with the connection pins 42 of the male attachment end 40. The male and female attachment ends 40 and 48 respectively, are brought into watertight contact with one another as the threads of the female attachment end 48 are selectively engaged with the inner threads of the operation ring 44.

The connecting tip 50 is equipped with a plurality of outwardly extending female posts 56 which are each utilized to anchor the individual conductors of an electrical cable 58 through a known soldering or crimping process, or the like.

Moreover, as shown in FIG. 2, a scotchcast 60 is employed through which the electrical cable 58 is fed. The scotchcast 60 is adapted to include a first mating end 62 and a second mating end 64. An end plug 66 is slidable along the electrical cable 58 and includes a first plug end 65 and a second plug end 67 wherein the first plug end 65 threadedly engages a second mating end of the scotchcast 64. A seal 68 is also slidably mounted about the electrical cable 58 and provides a watertight barrier when properly seated between the second plug end 67 and the electrical cable 58. An end cap 70 is slidably mounted about the electrical cable 58 and includes threads formed about the inner periphery thereof so as to threadedly engage with the second plug end 67.

A cut-out 61 is schematically shown in FIG. 2 to reveal a clamp 80 located within the housing of the scotchcast 60 and centered about the electrical cable 58. The clamp 80 is formed from a wear resistant material, such as metal or the like, and is held to the electrical cable 58 in a non-slidable fashion, through friction, in any of a number of conventional manners. When the end plug 66 is fully engaged with the second mating end 64, the electrical cable 58 is prohibited from being pulled free of the scotchcast 60 by the abutment between the clamp 80 and an end face 81 of the first plug end 65. The clamp 80 therefore greatly increases the pulling capacity of the scotchcast 60.

As also depicted in FIG. 2, a tension web 90 extends along the length of the electrical cable 58 and provides additional pulling capacity to the scotchcast 60. The tension web 90 is typically formed from a weave of metal, nylon or other resilient material and serves to tighten about the electrical cable 58 in proportion to the pull exerted upon the tension web 90. When utilized as a whole, the clamp 80 and the tension web 90 allow the scotchcast 60 to withstand stresses up to approximately 5000 lbs. of pulling capacity without endangering the integrity of the electrical cable 158.

While effective, it will be readily appreciated that much time and great care had to be employed in order to solder each individual terminal end of the conductors in the electrical cable 58 to the posts 56, as shown in FIG. 2. Moreover, once accomplished, these fixed and soldered connections may actually become an impediment should an operator wish to adapt the wiring schematic of the electrical cable 58 to a new application.

In addition, the clamp 80 was found to occupy a significant amount of room within the scotchcast 60 while providing only a measured increase to the pulling capacity of the scotchcast assembly 30. Moreover, the tension web 90 performed well until becoming caught or snagged upon a foreign object which, in turn, would cause the tension web 90 to bunch up and therefore lose much of its pulling capacity.

With the foregoing problems and concerns in mind, it would therefore be advantageous to develop a pigtailed scotchcast assembly, which overcomes the above-described drawbacks, thereby accommodating a quick and efficient adaptation of a differing wiring schematic and increased pulling capacity.

SUMMARY OF THE INVENTION

It is therefore an object of the present invention provide a scotchcast assembly which may allow for efficient exchange or replacement of differing pigtails.

It is another object of the present invention to provide a scotchcast assembly, which allows for the exchange or replacement of differing pigtails without the need for special instruments or in-depth electrical knowledge.

It is another object of the present invention to provide a scotchcast assembly which allows for the quick and efficient adaptation of a differing wiring schematic.

It is another object of the present invention to provide a scotchcast assembly having increased pulling capability.

According to one embodiment of the present invention, an integrated inspection apparatus for selectively accepting an electrical cable includes a scotchcast having a housing through which the electrical cable extends. The inspection apparatus further includes a block clamp having a passage formed along its longitudinal axis for accommodating a portion of the electrical cable, the portion of the electrical cable being disposed outside of the scotchcast. The block clamp further includes a cap portion which is selectively actuated to provide a compressive force on the electrical cable without deforming an exterior profile of the block clamp.

DETAILED DESCRIPTION OF THE PREFERRED EMBODIMENTS

Figure 2:
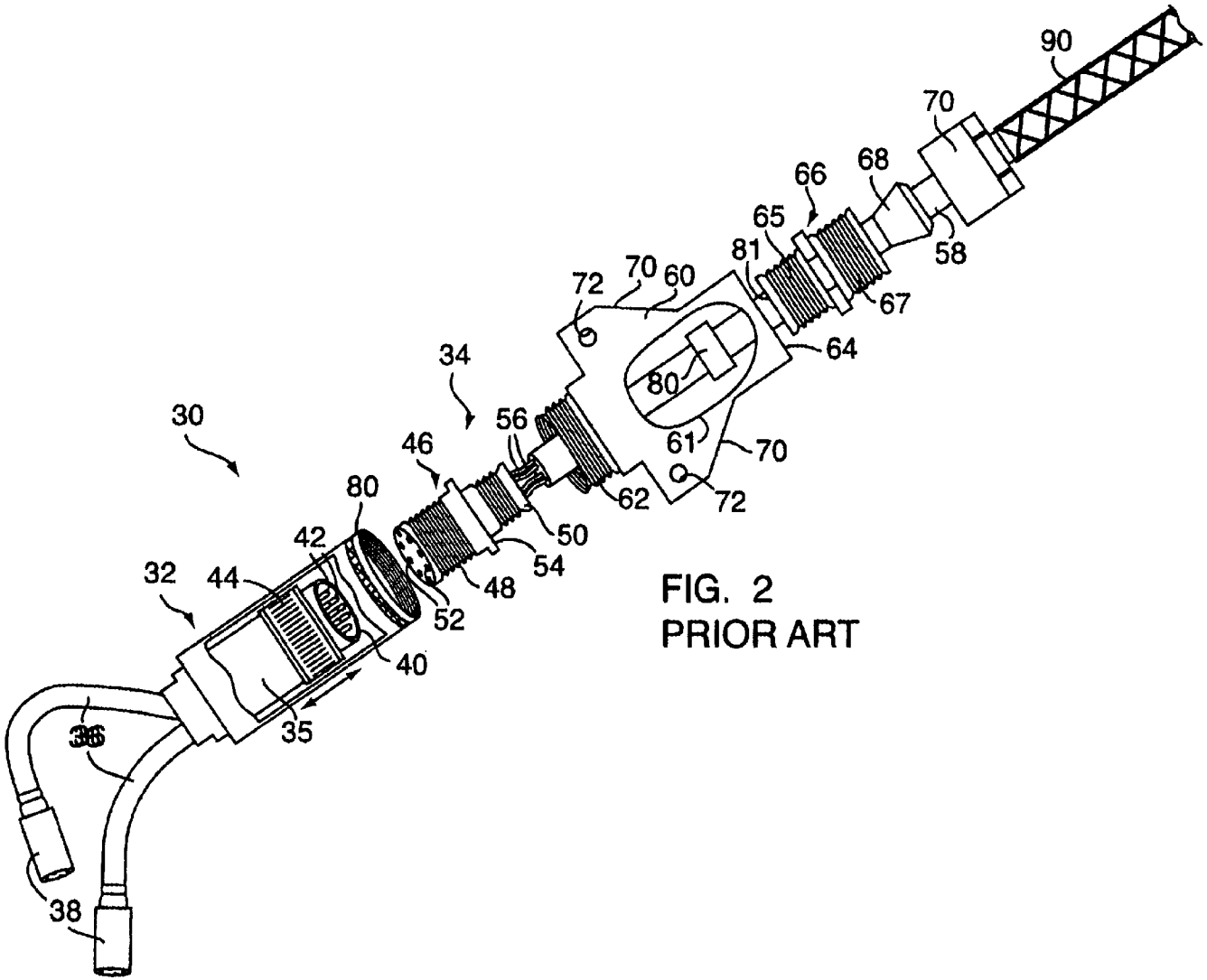
FIG. 2 PRIOR ART
FIG. 2 illustrates a composite view of a known two-piece scotchcast assembly utilizing soldered connections and a tension web.
Figure 3:
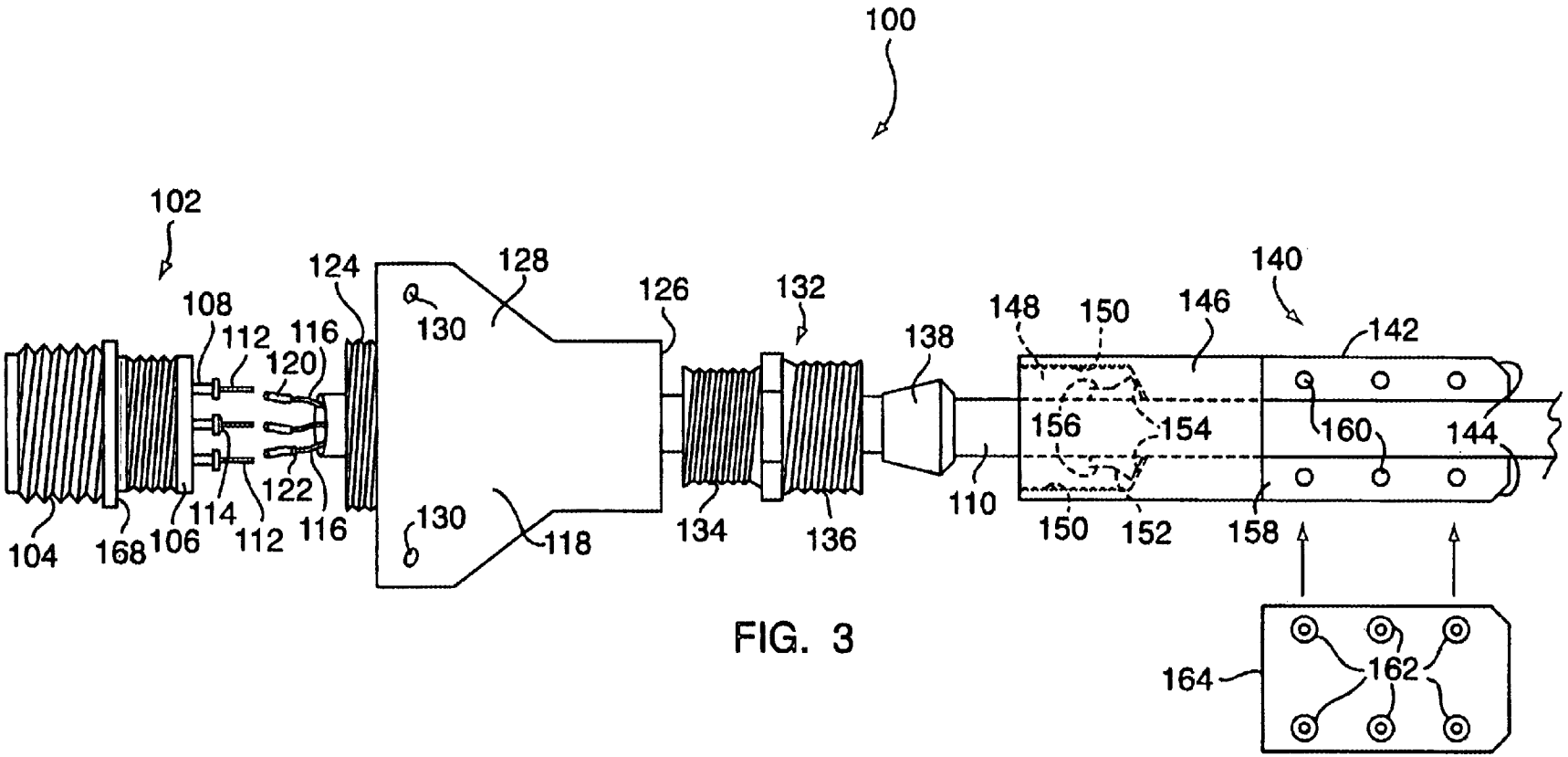
FIG. 3 illustrates a scotchcast assembly, according to one embodiment of the present invention.

FIG. 3 depicts a scotchcast assembly 100 according to one embodiment of the present invention. Although not illustrated in FIG. 3, the scotchcast assembly 100 is designed to operatively mate with a pigtail assembly, such as is represented by numeral 32 in prior art FIG. 2, and herein incorporated by reference in its entirety.

As depicted in FIG. 3, the present invention is directed towards a scotchcast assembly 100 which is comprised of a threaded connection piece, or amphenol, 102 having a female attachment end 104 and a connecting tip 106. The female attachment end 104 has exterior threads formed on the outer circumference thereof and further includes a plurality of non-illustrated pin receptacles. The non-illustrated pin receptacles are arranged in number and orientation so as to match and integrally mate with a matching number of connection pins 42 protruding from the body of the pigtail assembly 32, as shown in FIG. 2.

The connecting tip 106 also has exterior threads formed on the outer circumference thereof, as well as being equipped with a plurality of outwardly extending posts 108. As discussed in conjunction with prior art FIG. 2, the outwardly extending posts 108 have previously been utilized to accept and anchor the individual conductors of an electrical cable 110 via a known soldering or crimping process, or the like. In contrast with this known arrangement, the scotchcast assembly 100 of the present invention instead utilizes the outwardly extending posts 108 to accept and anchor a matching number of male connectors 112, also connected via a soldered joint 114, or the like.

As is further shown by FIG. 3, the electrical cable 110 includes a plurality of nested, yet separate, conductors 116. The conductors 116 extend through the scotchcast 118 and protrude from the rear thereof prior to final integration of the scotchcast assembly 100. Rather than leaving the bare, distal ends of the conductors 116 free to facilitate a soldering action, as was the case in the prior art scotchcast assembly shown in FIG. 2, the scotchcast assembly 100 of the present invention instead anchors a matching number of female connectors 120 to the distal ends of the conductors 116, via a soldering joint 122 or the like. As will be appreciated, the male connectors 112 and the female connectors 120 may be of any size or configuration, provided that they integrally and releasably mate with one another.

It is therefore an important aspect of the present invention that the scotchcast assembly 100 does not directly solder or otherwise fixedly attach the bare, distal ends of the conductors 116 to the outwardly extending posts 108. Instead, the male and female connectors, 112 and 120 respectively, are utilized in order to provide a secure, yet selectively removable, connection between the outwardly extending posts 108 and the conductors 116 of the electrical cable 110. In this manner, the present invention accommodates a quick and efficient adaptation of any differing wiring schematics which may be necessary. That is, by not having a fixed, soldered connection between the outwardly extending posts 108 and the bare, distal ends of the conductors 116, the present invention avoids the laborious and time consuming necessity of heating these soldered joints prior to rearranging the connections therebetween. Thus, the selectively removable interface created by the male and female connectors, 112 and 120, significantly reduce the time and effort needed to adapt to differing schematic configurations without requiring any additional heating or splicing steps.

It will be readily appreciated that although FIG. 3 illustrates three conductors 116 and a matching number of outwardly extending posts 108, the present invention is not limited in this regard as any number of conductors and matching posts are also contemplated by the present invention. Moreover, although the present invention has stipulated that the outwardly extending posts 108 have the male connectors 112 affixed thereto, while the conductors 116 themselves have affixed thereon the female connectors 120, the present invention is not limited in this regard as the male and female connectors, 112 and 120, may be alternatively affixed to either the outwardly extending posts 108, or the conductors 116, without departing from the broader aspects of the present invention.

The present invention also contemplates the use of shrink-wrap tubing, or the like, which may be slid over the conductors 116 prior to the male and female connectors, 112 and 120, being affixed. After the male and female connectors, 112 and 120, are soldered to the posts 108 and the conductors 116, respectively, the shrink-wrap tubing may then be moved to cover the mated male and female connectors, 112 and 120, and subsequently shrunk, further insuring that the engagement between the male and female connectors, 112 and 120, remain intact. When a change is thereafter necessary or desired, the shrink-wrap tubing need only be peeled away to enable the unplugging of the male and female connectors, 112 and 120.

Returning to FIG. 3, the female attachment end 104 and the connecting tip 106 are adapted to include interior electrical conduits (unillustrated) for providing a plurality of continuous electrically conductive passages through the connection piece 102. While the connection piece 102, as shown in FIG. 3, is depicted as a one-piece element, the present invention is not limited in this regard as the connection piece 102 may be alternatively formed by a plurality of electrically interconnected elements without departing from the broader aspects of the present invention.

As previously mentioned, the scotchcast 118 includes an inner cavity through which the electrical cable 110 is fed. The scotchcast 118 is further adapted to include a first mating end 124 and a second mating end 126 and provides, inter alia, a watertight protective enclosure for the interface between the connecting tip 102 and the electrical cable 110. The first mating end 124 is configured to integrally mate with the connecting tip 124 and therefore has a series of non-illustrated threads inscribed about the inner circumference thereof. In addition, the first mating end 124 includes has a series of threads inscribed about the outer circumference thereof for integrally mating with a protective sheath of the pigtail assembly, in accordance with the known embodiment depicted in prior art FIG. 2.

The scotchcast 118 further includes a pair of wings 128, each having an anchor hole 130 formed therein for dragging or pulling the scotchcast assembly 100 along a cavity or piping. While a pair of wings 128 has been described as facilitating the dragging or pulling of the scotchcast 118 along a cavity or piping, the present invention is not limited in this regard as alternative locations for the anchor holes, such as through the body of the scotchcast 118, may be utilized without departing from the broader aspects of the present invention. Moreover, other known methods for dragging the scotchcast assembly 100 are also contemplated by the present invention.

The second mating end 126 itself has a series of threads inscribed about the inner circumference thereof for securably mating with an end plug 132 which is slidable along the electrical cable 110. The end plug 132 includes a first plug end 134 and a second plug end 136, wherein the first plug end 134 threadedly engages the second mating end 126 of the scotchcast 118. A seal 138 is also slidably mounted about the electrical cable 110 and provides a watertight barrier when properly seated between the second plug end 136 and the electrical cable 110 in a manner to be described in more detail later.

A two-piece block clamp 140 is also illustrated in FIG. 3 and is utilized to provide the scotchcast assembly 100 with a significantly greater pulling capacity than has been previously known in the art. Although shown in plan view in FIG. 3, the block clamp 140 is designed to have a substantially tubular exterior housing 142 with at least one tapered end 144. The block clamp 140 includes a first portion 146 including an inner cavity 148 and is adapted for accommodating the electrical cable 110 along longitudinal length thereof. The inner cavity 148 itself defines a series of inscribed inner threads 150 (depicted in phantom lines in FIG. 3) for mating engagement with the external threads of the second plug end 136 of the end plug 132.

Also shown disposed within the inner cavity 148 is a plastic insert 152. The insert 152 is slidable along the electrical cable 110 and is shaped to conform to the tapered walls 154 of the inner cavity when seated therein. The insert 152 includes a plurality of longitudinally extending arms 156 arranged about the circumference of the electrical cable 110, and is intended to interact with the seal 138 to assist in the creation of a watertight enclosure for the scotchcast assembly 100. The seal 138 may be formed to include a series of circumferentially spaced apertures to accept the arms 156 of the insert 152 for increased watertight mating. Moreover, although a plastic insert has been described, the present invention is not limited in this regard as other elastic or resilient materials may alternatively be used for the insert 152 without departing from the broader aspects of the present invention.

The block clamp 140 further includes a second portion 158 for accommodating the electrical cable 110 along its longitudinal length. The second portion 158 has a series of threaded bores 160 formed therein which are adapted for mating engagement with suitably sized bolts, or the like, extending through a matching plurality of apertures 162 formed in a cap portion 164. The cap portion 164 is thereby releasably secured to the second portion 158 and may therefore selectively exert an increasing amount of frictional pressure upon the electrical cable 110 caught therebetween as the bolts are correspondingly tightened.

It is therefore another important aspect of the present invention that the block clamp 140 is capable of exerting a substantially increased amount of compressive and frictional force upon the electrical cable 110 disposed therein. Moreover, by enabling the selective and incremental application of increased compression and friction, the block clamp 140 may be equally employed with standard electrical wiring, as well as fiber optic cables that may demand less compression in order to avoid structural damage.

Figure 5:
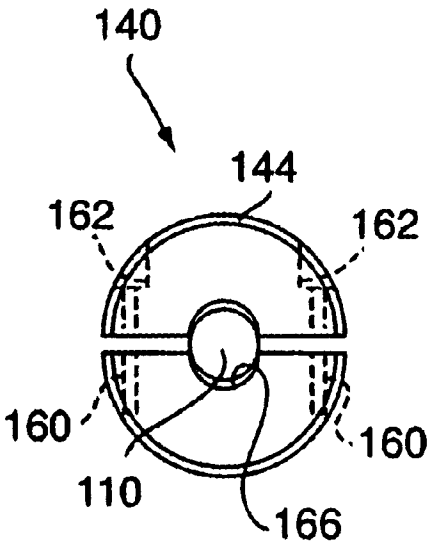
FIG. 5 is a front view of a block clamp utilized in conjunction with the scotchcast assembly of FIG. 3.
Figure 4:
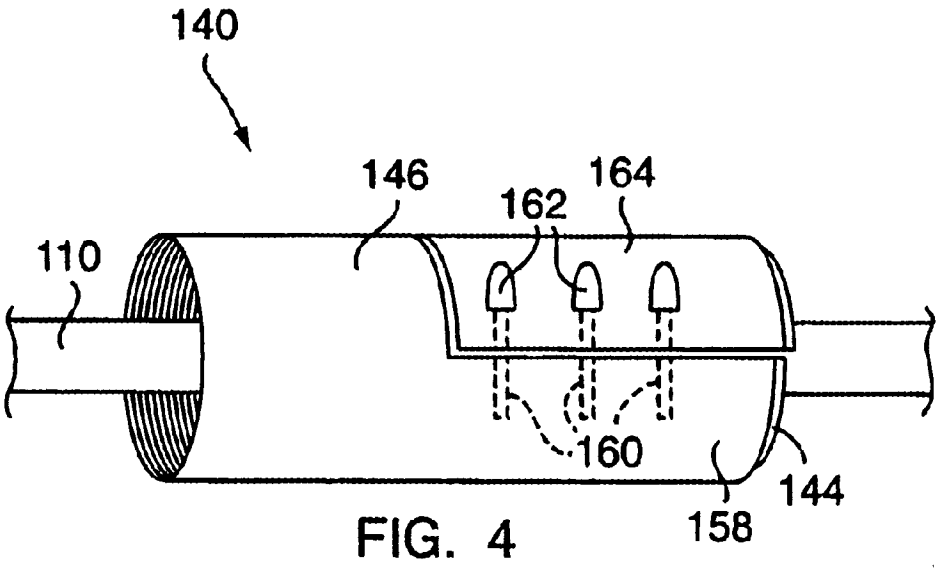
FIG. 4 is a side view of a block clamp utilized in conjunction with the scotchcast assembly of FIG. 3.

FIG. 4 illustrates a side view of the block clamp 140, while FIG. 5 illustrates an end view of the block clamp 140. As seen in FIGS. 4 and 5, the block clamp 140 employs the tapered ends 144 so as to reduce the possibility that the block clamp 140 will become snagged during use. Moreover, as best seen in FIG. 5, the first portion 146, the second portion 158 and the cap portion 164 all include a hemispherical passage 166 formed along the longitudinal length of the block clamp 140 in order to accommodate the electrical cable 110 therein.

It will be readily appreciated that the size of the hemispherical cavity 166 will be chosen in dependence upon the size, or gauge, of the electrical cable 110 and, more preferably, is typically chosen to be slightly smaller in diameter than the electrical cable 110 to assure a tight fitting compression of the same. Moreover, it will also be readily appreciated that the compressive force of the block clamp 140 is significantly greater than the clamp previously utilized in conjunction with prior art FIG. 2. That is, by forming the block clamp 140 so as to extend along a predetermined length of the electrical cable 110, the present invention provides much greater pulling capacity than the clamp utilized in FIG. 2. Also, the matching plurality of bores 160 and apertures 162 formed in the block clamp 140 provide a level of selective compression that the prior art devices and clamps are incapable of replicating.

It is another important aspect of the present invention that the greater pulling capacity given to the scotchcast assembly 100 as a result of the block clamp 140 effectively obviates the need for the tension web of prior art FIG. 2, or the like, thus eliminating the possibility that the scotchcast assembly 100 will become snagged as the result of any such tension web during use.

It will be readily appreciated that the block clamp 140 may itself have any particular size or shape and may be manufactured from any suitable material, including but not limited to metal, plastic, or the like, without departing from the broader aspects of the present invention.

In operation, the electrical cable 110 is initially chosen in dependence upon the desired electrical capacity or application and is threaded through the block clamp 140, the insert 152, the seal 138 and the scotchcast 118. The individual conductors 116 of the electrical cable 110 are then electrically coupled to the female connectors 120 through a soldering action or the like. The internal threads of the first mating end 124 are then selectively mated with the threads of the connecting tip 106 until the first mating end 124 is securely seated against a flange 168 of the connection piece 102. The second plug end 136 and the seal 138 are subsequently mated with the internal threads 150 of the block clamp 140, while the second mating end 126 is also mated with the first plug end 134, thereby effectively sealing the interior of the scotchcast 118 in a watertight manner.

Figure 1:
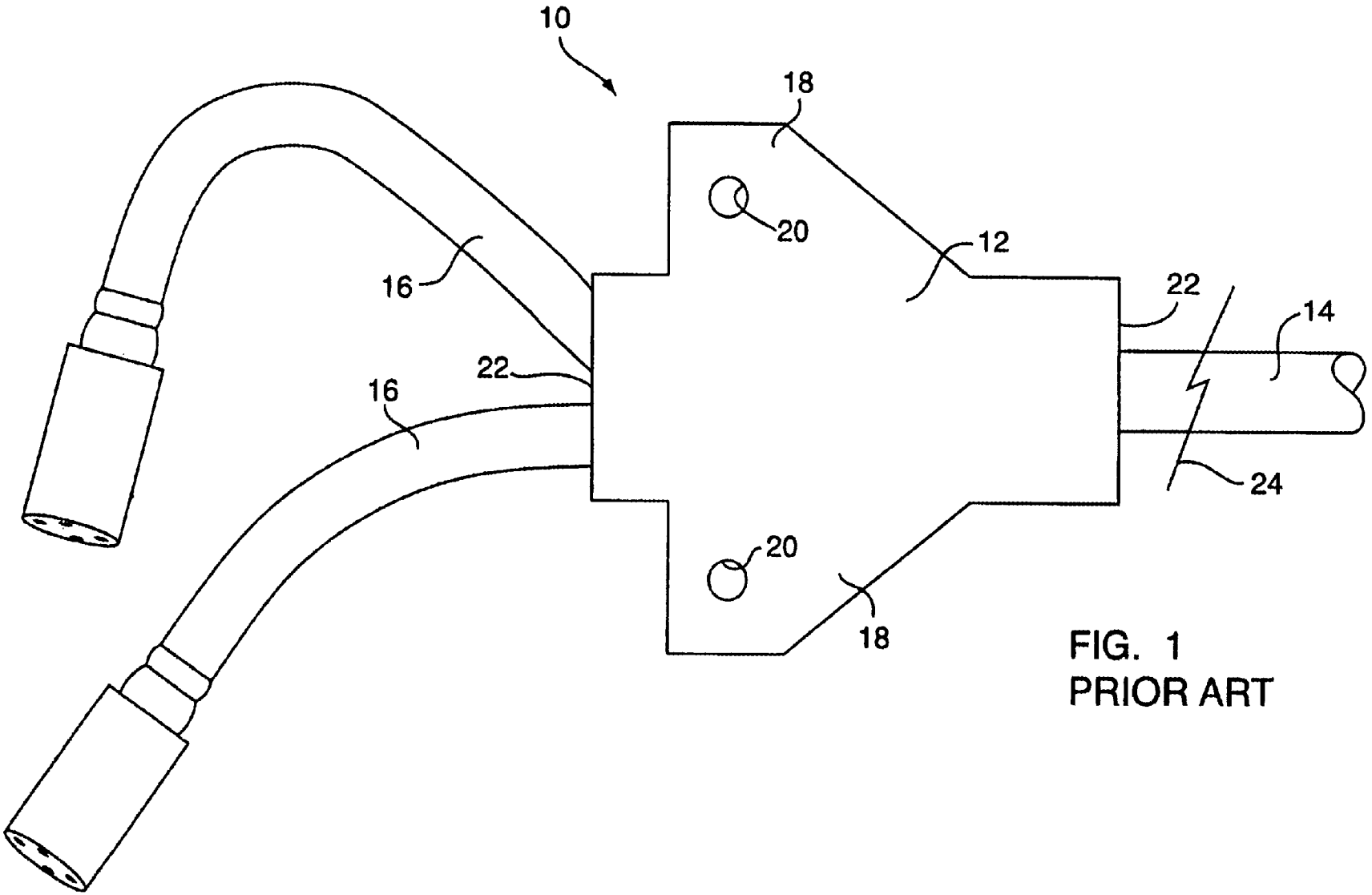
FIG. 1 PRIOR ART
FIG. 1 illustrates a one-piece pigtailed scotchcast assembly, as is commonly known in the art.

Now that the scotchcast assembly 100 has been described in connection with the drawing FIGS. 3–5, the benefits and advantages of such a configuration, as compared to the prior art pigtailed scotchcast assemblies illustrated in FIGS. 1 and 2, will be readily evident.

It should also be understood that the scotchcast 118 may be selectively injected with either a resin compound or a dielectric fluid, so as to further increase the pulling capacity of the scotchcast 118, as well as reinforcing the hydrophobic environment within the housing of the scotchcast 118, although such a resin compound is not necessary or, in some cases, even desirable. It will also be readily appreciated that a major aspect of the present invention resides in the ability of the scotchcast assembly 100 to withstand excessive pulling tensions without the need for either a resin filled scotchcast 118 or a tension web, due to the increased compressive and frictional force applied to the electrical cable 110 by the block clamp 140.

While a preferred embodiment has been shown and described, various modifications and substitutions may be made without departing from the spirit and scope of the present invention. Accordingly, it is to be understood that the present invention has been described by way of example, and not by limitation.

What is claimed is:

1. An integrated inspection apparatus for selectively housing therein an electrical cable, comprising:

a scotchcast having a housing through which said electrical cable extends;

a block clamp having a passage formed along its longitudinal axis for accommodating a portion of said electrical cable therein, said portion of said electrical cable being disposed outside of said scotchcast; and wherein said block clamp further includes a cap portion which is selectively actuated to provide a compressive force on said electrical cable without deforming an exterior profile of said block clamp.

2. The integrated inspection apparatus for selectively housing therein an electrical cable according to claim 1, wherein:

said cap portion is selectively removable from said block clamp.

3. The integrated inspection apparatus for selectively housing therein an electrical cable according to claim 1, wherein:

said cap portion includes an aperture; and said block clamp includes a threaded bore formed therein, said threaded bore being concentrically aligned with said aperture.

4. The integrated inspection apparatus for selectively housing therein an electrical cable according to claim 3, further comprising:

a fastener extending through said aperture into said threaded bore, wherein said fastener is selectively operated to integrally mate with said threaded bore and thereby draw said cap portion into compression against said electrical cable.

5. The integrated inspection apparatus for selectively housing therein an electrical cable according to claim 1, further comprising:

an end plug having a first threaded end and a second threaded end, said first threaded end integrally mating with said scotchcast; and a seal disposed about said electrical cable, said seal nesting within said second threaded end.

6. The integrated inspection apparatus for selectively housing therein an electrical cable according to claim 5, wherein:

said block clamp includes a threaded inner cavity; and said second threaded end of said end plug integrally mating with said threaded inner cavity.

7. The integrated inspection apparatus for selectively housing therein an electrical cable according to claim 6, wherein:

said threaded inner cavity includes a tapered end adjacent said longitudinal passage of said block clamp.

8. The integrated inspection apparatus for selectively housing therein an electrical cable according to claim 7, further comprising:

an insert disposed about said electrical cable and nesting within said inner cavity, said insert having a base conforming to said tapered end.

9. The integrated inspection apparatus for selectively housing therein an electrical cable according to claim 8, wherein:

said insert includes an arm extending along said electrical cable.

10. The integrated inspection apparatus for selectively housing therein an electrical cable according to claim 1, wherein:

said electrical cable includes a conductor housed therein; and wherein a distal end of said conductor supports one of a male connector and a female connector.

11. The integrated inspection apparatus for selectively housing therein an electrical cable according to claim 10, further comprising:

an amphenol operatively connected to said scotchcast, said amphenol having an outwardly extending post which supports one of said male connector and said female connector which is not supported on said distal end of said conductor; and wherein said distal end of said conductor is operatively connected to said amphenol via a mating of said male connector with said female connector.

12. The integrated inspection apparatus for selectively housing therein an electrical cable according to claim 1, wherein:

said block clamp includes a threaded inner cavity.

13. The integrated inspection apparatus for selectively housing therein an electrical cable according to claim 12, wherein:

said threaded inner cavity includes a tapered end adjacent said longitudinal passage of said block clamp.

14. An integrated inspection apparatus for selectively housing therein an electrical cable, comprising:

a scotchcast having a housing through which said electrical cable extends, said electrical cable housing a conductor wherein a distal end of said conductor supports one of a male connector and a female connector.

an amphenol operatively connected to said scotchcast, said amphenol having an outwardly extending post which supports one of said male connector and said female connector which is not supported on said distal end of said conductor; and wherein said distal end of said conductor is operatively connected to said amphenol via a mating of said male connector with said female connector.

15. The integrated inspection apparatus for selectively housing therein an electrical cable, further comprising:

a block clamp having a passage formed along its longitudinal axis for accommodating a portion of said electrical cable therein, said portion of said electrical cable being disposed outside of said scotchcast; and wherein said block clamp further includes a cap portion which is selectively actuated to provide a compressive force on said electrical cable without deforming an exterior profile of said block clamp.

16. The integrated inspection apparatus for selectively housing therein an electrical cable according to claim 15, wherein:

said cap portion is selectively removable from said block clamp.

17. The integrated inspection apparatus for selectively housing therein an electrical cable according to claim 16, wherein:

said cap portion includes an aperture; and said block clamp includes a threaded bore formed therein, said threaded bore being concentrically aligned with said aperture.

18. The integrated inspection apparatus for selectively housing therein an electrical cable according to claim 17, further comprising:

a fastener extending through said aperture into said threaded bore, wherein said fastener is selectively operated to integrally mate with said threaded bore and thereby draw said cap portion into compression against said electrical cable.

19. The integrated inspection apparatus for selectively housing therein an electrical cable according to claim 14, further comprising:

an end plug having a first threaded end and a second threaded end, said first threaded end integrally mating with said scotchcast; and a seal disposed about said electrical cable, said seal nesting within said second threaded end.

20. The integrated inspection apparatus for selectively housing therein an electrical cable according to claim 19, wherein:

said block clamp includes a threaded inner cavity having a tapered end adjacent said longitudinal passage of said block clamp; and said second threaded end of said end plug integrally mating with said threaded inner cavity.

* * * * *

UNITED STATES PATENT AND TRADEMARK OFFICE

CERTIFICATE OF CORRECTION

PATENT NO. : 6,851,969 B2
DATED : February 8, 2005
INVENTOR(S) : David Archuleta It is certified that error appears in the above-identified patent and that said Letters Patent is hereby corrected as shown below:

Title page,
Item [75], Inventor, "Archuletta" should read -- Archuleta --.
Item [57], ABSTRACT,
Line 6, after "electrical cable,", please delete "the portion" (first occurance).

Signed and Sealed this

Twenty-sixth Day of April, 2005

JON W. DUDAS
*Director of the United States Patent and Trademark Office*